US010364070B2

(12) United States Patent
Kapolas et al.

(10) Patent No.: US 10,364,070 B2
(45) **Date of Patent: *Jul. 30, 2019**

(54) METAL CLOSURE WITH LOW PRESSURE ENGAGEMENT LUGS

(71) Applicant: Silgan White Cap LLC, Downers Grove, IL (US)

(72) Inventors: William J. Kapolas, Palatine, IL (US); Dennis Szczesniak, Lemont, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/608,353

(22) Filed: May 30, 2017

(65) Prior Publication Data

US 2017/0267414 A1 Sep. 21, 2017

Related U.S. Application Data

(63) Continuation of application No. 15/014,909, filed on Feb. 3, 2016, now Pat. No. 9,694,946, which is a (Continued)

(51) Int. Cl.

| | |
|---|---|
| ***B65D 41/04*** | (2006.01) |
| ***B65D 43/02*** | (2006.01) |
| *B65D 41/06* | (2006.01) |

(52) U.S. Cl.

CPC ..... *B65D 41/04* (2013.01); *B65D 41/0471* (2013.01); *B65D 43/0231* (2013.01);

(Continued)

(58) Field of Classification Search

CPC ..... B65D 41/04; B65D 41/0471; B65D 43/0231; B65D 2543/00092;

(Continued)

(56) References Cited

U.S. PATENT DOCUMENTS 1,516,046 A 11/1924 Lee
1,574,084 A * 2/1926 Hamilton ..... A47F 7/03 206/565

(Continued)

FOREIGN PATENT DOCUMENTS

EP 0008502 B1 3/1980
EP 0106524 A2 4/1984

(Continued)

OTHER PUBLICATIONS

International Search Report and Written Opinion for PCT/US2015/024648, dated Jul. 13, 2015, 14 pages.

(Continued)

*Primary Examiner* — J. Gregory Pickett
*Assistant Examiner* — Niki M Eloshway
(74) *Attorney, Agent, or Firm* — Reinhart Boerner Van Deuren S.C.

(57) ABSTRACT

A metal closure having multiple thread engaging lugs configured to decrease the pressure exerted by the closure lugs on the neck of a container is provided. In various embodiments, the metal closure comprises a top wall, a skirt extending downward from a peripheral edge of the top wall, a lower edge included on the skirt, and a plurality of lugs formed at the lower edge of the skirt. Pressure may be decreased by the closure having more lugs and/or larger lugs than other metal closures.

18 Claims, 6 Drawing Sheets

Related U.S. Application Data continuation of application No. PCT/US2015/024648, filed on Apr. 7, 2015.

(60) Provisional application No. 61/978,524, filed on Apr. 11, 2014.

(52) U.S. Cl.
CPC ..... *B65D 2543/00092* (2013.01); *B65D 2543/00277* (2013.01); *B65D 2543/00527* (2013.01); *B65D 2543/00537* (2013.01)

(58) Field of Classification Search
CPC ..... B65D 2543/00277; B65D 2543/00527; B65D 2543/00537
USPC ..... 220/298, 296; 215/333, 337, 340, 339, 215/44
See application file for complete search history.

(56) References Cited

U.S. PATENT DOCUMENTS

| | | | | |
|---|---|---|---|---|
| 1,574,085 | A | 2/1926 | Hammer | |
| 1,605,848 | A * | 11/1926 | Merolle | B65D 41/04 215/333 |
| 1,683,388 | A | 9/1928 | Hammer | |
| 1,784,089 | A | 12/1930 | Carr | |
| 2,008,587 | A | 7/1935 | Kramer | |
| 2,160,704 | A * | 5/1939 | Merolle | B65D 41/04 215/333 |
| 2,181,179 | A | 11/1939 | Eccleston | |
| 2,291,215 | A | 7/1942 | Enkur | |
| 2,317,287 | A | 4/1943 | McCombs | |
| 2,403,131 | A | 7/1946 | Smith | |
| 2,585,624 | A | 2/1952 | Bromley | |
| 3,229,841 | A | 1/1966 | Bailey | |
| 3,233,727 | A | 2/1966 | Wilson | |
| 3,253,727 | A * | 5/1966 | Hart | B65D 41/0442 215/333 |
| 3,323,672 | A | 6/1967 | Acton | |
| D209,789 | S | 1/1968 | Huston | |
| 3,446,381 | A | 5/1969 | Carlo et al. | |
| 3,465,908 | A | 9/1969 | Acton | |
| 3,469,727 | A * | 9/1969 | Acton | B65D 41/3485 215/255 |
| 3,516,565 | A | 6/1970 | Hatkevich | |
| 3,682,345 | A | 8/1972 | Baugh | |
| 3,707,241 | A | 12/1972 | Taylor | |
| 3,782,574 | A | 1/1974 | Rumble | |
| 3,788,508 | A | 1/1974 | Vercillo | |
| 3,880,313 | A | 4/1975 | Akers | |
| 3,980,194 | A | 9/1976 | Costa | |
| 4,081,098 | A | 3/1978 | Johansson | |
| 4,084,717 | A | 4/1978 | King | |
| 4,202,462 | A | 5/1980 | Imber | |
| D261,486 | S | 10/1981 | Smith | |
| D263,685 | S | 4/1982 | Smith | |
| D264,441 | S | 5/1982 | Smith | |
| 4,392,580 | A * | 7/1983 | Ochs | B21D 51/44 215/332 |
| 4,433,790 | A | 2/1984 | Gibson | |
| 4,485,932 | A | 12/1984 | Kusz | |
| 4,813,557 | A | 3/1989 | Herron et al. | |
| 4,877,144 | A | 10/1989 | Thanisch | |
| D380,385 | S | 7/1997 | Litke | |
| 5,693,036 | A | 12/1997 | Kilgour | |
| 5,836,468 | A | 11/1998 | Bosl et al. | |
| 6,227,391 | B1 | 5/2001 | King | |
| 6,841,117 | B1 | 1/2005 | Smith et al. | |
| D650,669 | S | 12/2011 | Dunwoody | |
| D650,670 | S | 12/2011 | Dunwoody | |
| D651,081 | S | 12/2011 | Dunwoody | |
| D651,082 | S | 12/2011 | Dunwoody | |
| 9,096,356 | B2 * | 8/2015 | Bates | B65D 41/0464 |
| 9,694,946 | B2 * | 7/2017 | Kapolas | B65D 41/04 |
| 2005/0128870 | A1 | 6/2005 | Garcia | |
| 2005/0242055 | A1 | 11/2005 | Oh | |
| 2007/0045216 | A1 | 3/2007 | Gami et al. | |
| 2007/0045320 | A1 | 3/2007 | Biesecker et al. | |
| 2007/0175854 | A1 | 8/2007 | Penny | |
| 2009/0236302 | A1 | 9/2009 | Labadie et al. | |
| 2009/0283492 | A1 | 11/2009 | Molinaro et al. | |
| 2010/0295211 | A1 | 11/2010 | Poel-Asendprf et al. | |
| 2011/0174759 | A1 | 7/2011 | Titherington | |
| 2015/0246754 | A1 | 9/2015 | Bates et al. | |
| 2016/0016696 | A1 | 1/2016 | Bates et al. | |
| 2016/0016697 | A1 | 1/2016 | Bates et al. | |
| 2016/0114940 | A1 | 4/2016 | Bates et al. | |
| 2016/0152384 | A1 | 6/2016 | Kapolas et al. | |

FOREIGN PATENT DOCUMENTS

| | | |
|---|---|---|
| EP | 0422880 | 4/1991 |
| EP | 30066017 | 9/2016 |
| WO | WO 2014/150483 | 9/2014 |
| WO | WO 2015/157236 | 10/2015 |

OTHER PUBLICATIONS

Extended European Search Report regarding EP 15776911.8, dated May 3, 2017, 8 pages.

European Patent Office, "Communication pursuant to Article 94(3) EPC," issued in connection with European Patent Application No. 15776911.8, dated Feb. 26, 2018, 6 pages.

* cited by examiner

METAL CLOSURE WITH LOW PRESSURE ENGAGEMENT LUGS

CROSS-REFERENCE TO RELATED PATENT APPLICATION

This application is a continuation of U.S. non-provisional patent application Ser. No. 15/014,909, filed Feb. 3, 2016, which is a continuation of International Application No. PCT/US2015/024648, filed Apr. 7, 2015, which claims the benefit of and priority to U.S. Provisional Patent Application No. 61/978,524 filed Apr. 11, 2014, each of which are incorporated herein by reference in their entireties.

BACKGROUND OF THE INVENTION

The present invention relates generally to the field of closures. The present invention relates specifically to a metal closure with multiple thread engaging lugs.

SUMMARY OF THE INVENTION

One embodiment of the invention relates to a metal closure having multiple thread engaging lugs, and in one embodiment the lug design is configured to decrease the pressure exerted by the closure lugs on the neck finish of the container.

One embodiment of the invention relates to a metal closure having a top wall, a skirt and a plurality of lugs. The skirt extends downwards from a peripheral edge of the top wall. A first end of the skirt is attached to the top wall. A second end of the skirt is defined by a lower edge. The lower edge is radially defined between an exterior surface and an interior surface. The closure includes a plurality of radially inwardly extending lugs located at positions about the lower edge. The interior surface of the lower edge at the positions of the lugs extend radially inwards relative to the interior surface of the lower edge of the skirt adjacent the lugs; The plurality of lugs occupy at least 25% of the length of the perimeter of the lower edge.

Another embodiment of the invention relates to a metal closure having a top wall, a sidewall, and a plurality of lugs. The top wall has a center point that lies along a central axis. The top wall is concentrically disposed about the central axis. The sidewall extends downward along its length from a peripheral edge of the top wall to a lower edge. The plurality of lugs, the top wall, and sidewall are formed from a single contiguous piece of metal. The lugs are deformed sections the sidewall that extend radially inwards towards the central axis. Adjacent lugs are separated from each other by undeformed portions of the sidewall. Adjacent lugs are separated from each other by undeformed portions of the sidewall. Each lug has a first end and a second end spaced from the first end in the circumferential direction. The angular distance between the first end and second end of each lug as measured from the central axis is at least 30°.

Another embodiment of the invention relates to a metal closure having a top wall, a skirt, and a plurality of lugs. The skirt extends downward from a peripheral edge of the top wall. The skirt includes a lower edge. At least five lugs are formed at the lower edge of the skirt.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a metal closure configured to exert a decreased pressure on the neck of a container are shown and described. In general, the metal closure discussed herein includes a plurality of lugs (e.g., five or more lugs) that have an increased width such that the sealing force is more evenly distributed around the neck of the container, thereby decreasing the pressure exerted on the container neck by the closure. In some embodiments, the container sealed by the closure is formed from a plastic material such as polyethylene terephthalate. In some applications, the plastic material of the container may be softened (e.g., by heat from a hot-fill process, steam retort, pasteurization, etc.), and the lower pressure lug design discussed herein acts to decrease or prevent deformation of the plastic material of the container neck that may otherwise be caused by a closure with a different, higher pressure lug design.

Figure 1:
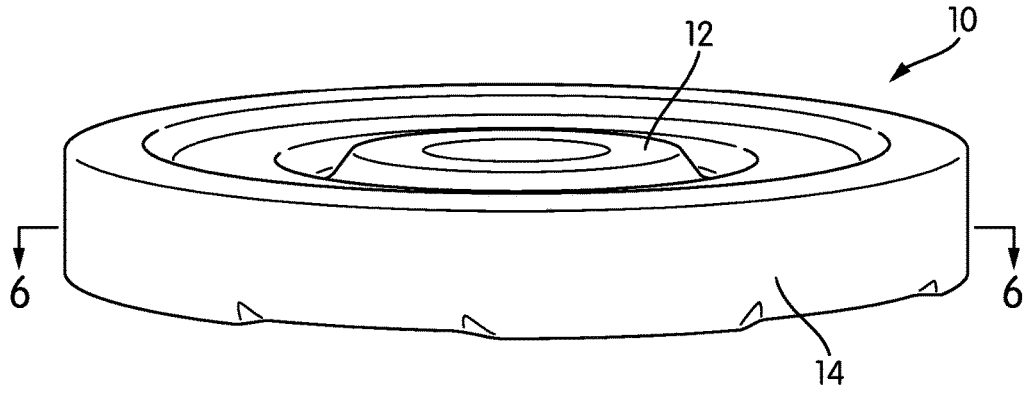
FIG. 1 is a top perspective view of a closure according to an exemplary embodiment.
Figure 2:
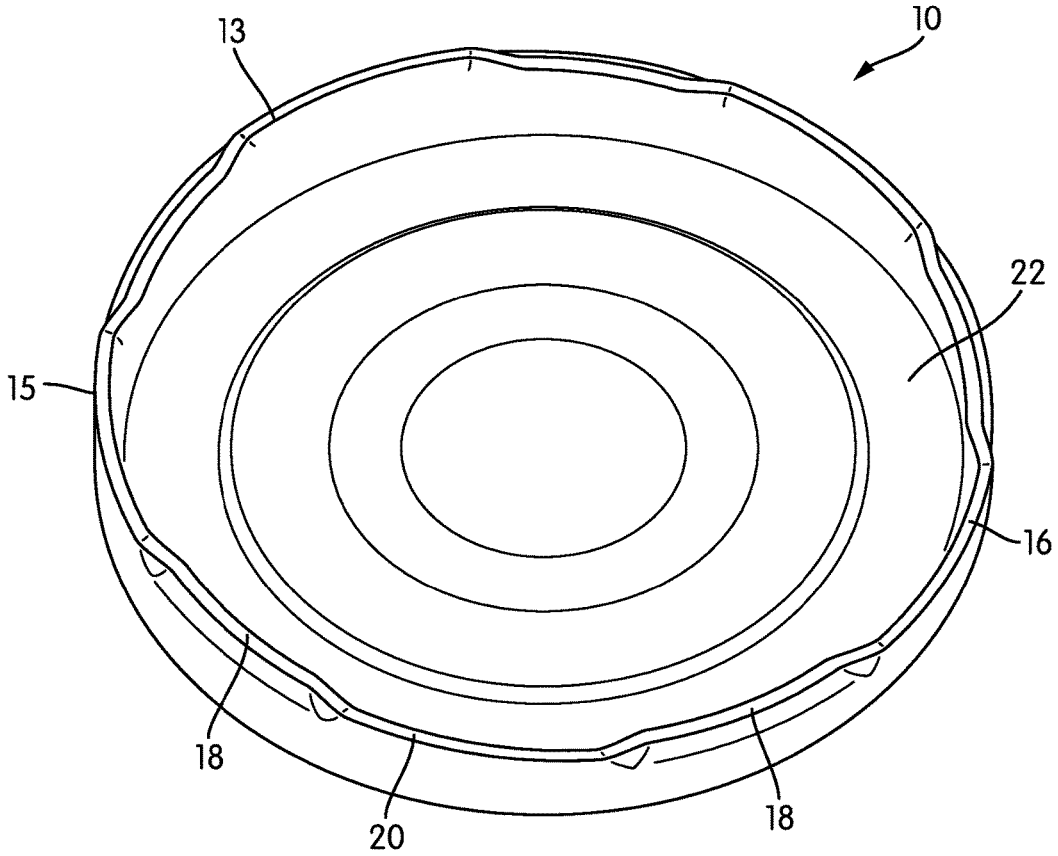
FIG. 2 is a bottom perspective view of a closure according to an exemplary embodiment.

Referring to FIG. 1 and FIG. 2, a metal closure 10 is shown according to an exemplary embodiment. Closure 10 includes a top wall 12, and a sidewall or skirt 14 extending downward from a peripheral edge of skirt 14. Skirt 14 has a lower edge 16 that extends in a radial direction between an inner surface 13 and an outer surface 15. In the embodiment shown, closure 10 is formed from a single contiguous piece of metal.

Closure 10 includes a plurality of engagement lugs, shown as lugs 18, formed at lower edge 16. Lugs 18 extend radially inward from the lower edge 16, and are formed by deforming a curled, rolled or crimped portion of the lower edge 16. In various embodiments, lugs 18 are also formed from sections of the skirt 14 that have been deformed to extend radially inwards towards the central axis of the closure 10, with adjacent lugs 18 separated from each other by undeformed portions of the skirt 14. In such embodiments, lugs 18 are also formed from the same single contiguous piece of metal that forms the rest of the closure 10.

As shown in FIG. 2, at those locations along the lower edge 16 about which lugs 18 are formed, the inner surface 13 of the lower edge 16 extends radially inwards from the inner surface 13 of those portions of the lower edge 16 about which no lugs 18 are formed. Additionally, in various embodiments, at those locations along the lower edge 16 where the lugs 18 are formed, the width of the lower edge 16 in a radial direction is greater than the width of the lower edge 16 in a radial direction at locations at which lugs 18 are not formed.

Figure 3:
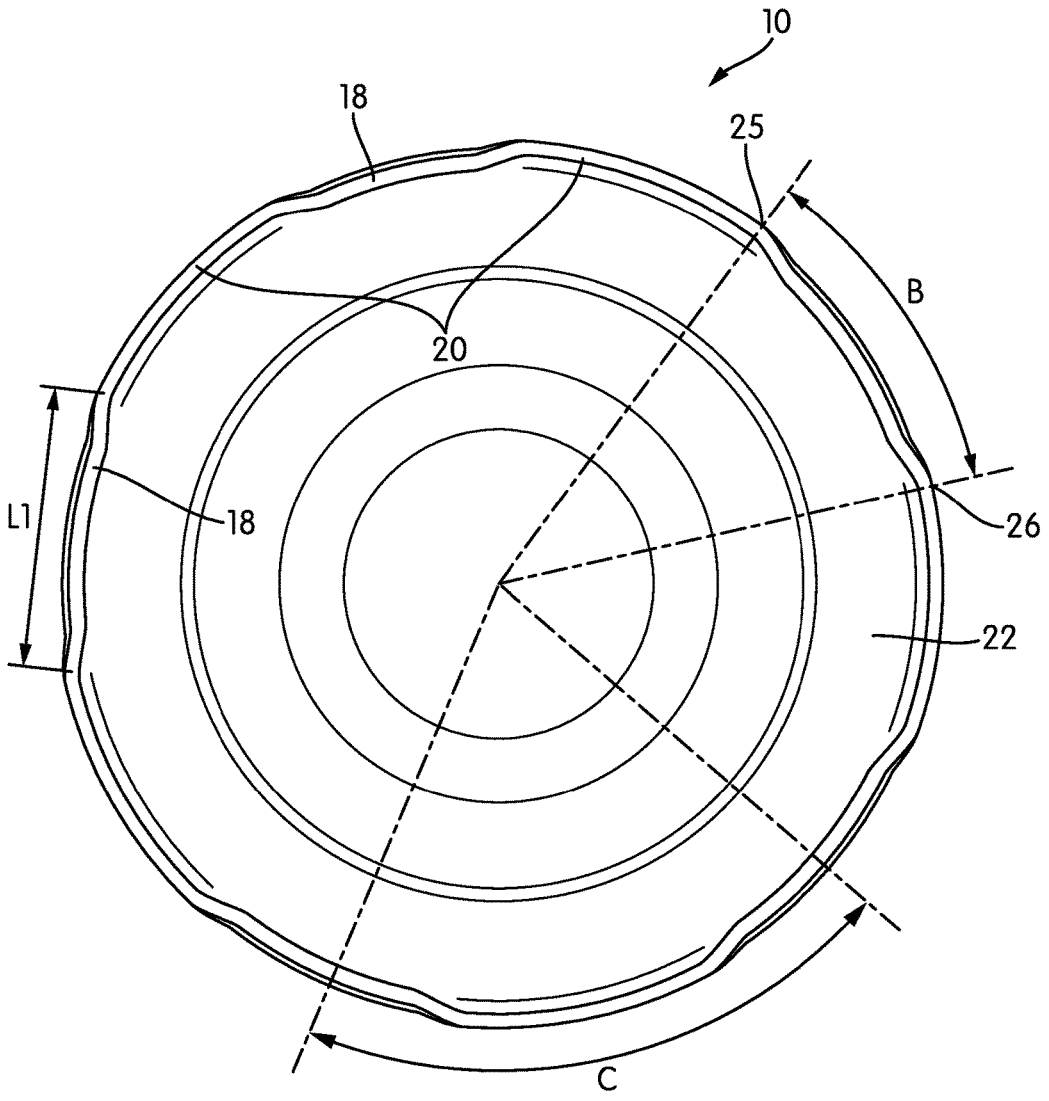
FIG. 3 is a bottom plan view of a closure according to an exemplary embodiment.

In one embodiment, closure 10 includes more than four lugs 18, and in one such embodiment closure 10 includes five lugs 18. Closure 10 includes a plurality of non-lugged, curved sections 20 located between each lug 18. The curvature of the non-lugged, curved sections 20 generally mirrors the curvature of the peripheral edge of the top wall 12. In one embodiment, closure 10 includes more than four non-lugged, curved sections 20, and in one such embodiment, closure 10 includes five non-lugged, curved sections 20. As shown in FIG. 3, in some embodiments, the lugs 18 are formed about the lower edge 16 of the skirt 14 such that none of the lugs 18 lie diametrically opposite each other.

Referring to FIG. 3, a bottom plan view of closure 10 is shown. As shown in FIG. 3, lugs 18 are evenly spaced around lower edge 16. In various embodiments, angle C is defined between the midpoints of adjacent lugs 18. Angle C is between 60 degrees and 80 degrees, and in a specific embodiment, the midpoint of each lug 18 is spaced about 72 degrees (e.g., 72 degrees plus or minus 1 degree) from the midpoint of an adjacent lug 18. In one embodiment, each lug 18 has a length generally in the circumferential direction shown as L1. In one embodiment, L1 is between 5 and 15 percent of the perimeter length of lower edge 16. In various embodiments, L1 is between 0.5 inches and 1.5 inches, and in a specific embodiment, L1 is about 0.75 inches. In one such embodiment, the diameter of closure 10 is 63 mm.

In various embodiments, each lug 18 defines an angle B relative to the center point of closure 10. Angle B is defined between a first lug end 25 and a second lug end 26 spaced from the first lug end 25 in a circumferential direction. In various embodiments, the angular distance between the first lug end 25 and the second lug end 26, i.e. angle B, is between 30 degrees and 50 degrees, specifically is between 35 degrees and 45 degrees and more specifically between 38 degrees and 42 degrees. In one embodiment, angle B is at least 30 degrees. In one embodiment, each lug 18 increases the contact area with the neck 32 of the container 30 by approximately 72% as compared to a standard four lug metal closure. Thus, in various embodiments, the increased length L1 of lugs 18 and the increased number of lugs 18 as compared to a standard four lug closure act to better distribute sealing forces around the neck 32 of the container 30 sealed by closure 10, and in some embodiments, this decrease in force acts to limit distortion of the container neck 32.

Figure 4:
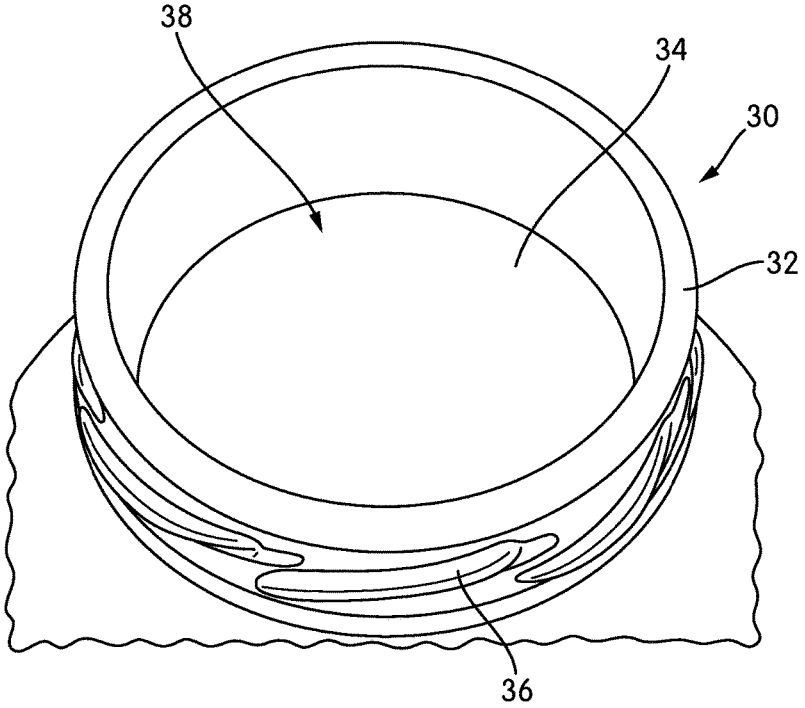
FIG. 4 is a container according to an exemplary embodiment.

In various embodiments, closure 10 is configured to seal a container such as container 30 shown in FIG. 4. Container 30 includes a neck 32 defining an opening 34. Threading 36 is formed on the outer surface of neck 32. In various embodiments, both the container 30 and the threading 36 are formed from a plastic material such as, but not limited to polyethylene terephthalate. An inner surface of container 30 defines a contents cavity 38 that may hold a variety of container contents including various food products. In general, lugs 18 of closure 10 engage threading 36 to attach closure 10 to neck 32 of container 30. As shown in FIG. 3, closure 10 includes a gasket material 22 that forms a hermetic seal with the upper rim of neck 32 during sealing. Gasket material 22 is located on the underside of top wall 12, surrounding the peripheral edge of the underside of the top wall 12 from which the skirt 14 extends. In various embodiments, the gasket material 22 may also surround the inner corner formed at the juncture between the underside of the top wall 12 and the interior surface of the downwardly extending skirt 14. Gasket material 22 may be a deformable polymer material, such as a thermoplastic elastomer material, that forms a seal with container neck 32 upon application of closure 10.

Figure 5:
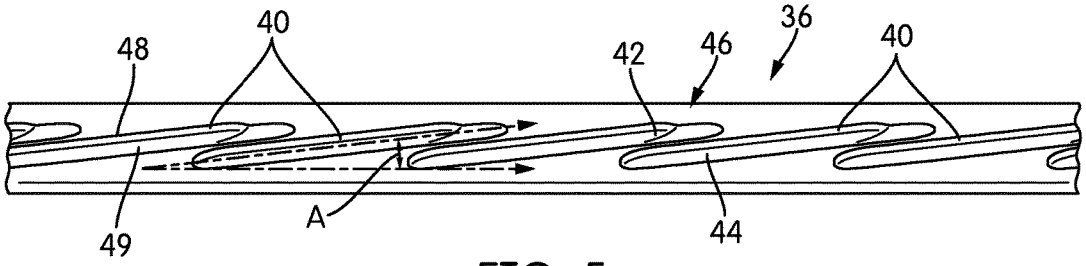
FIG. 5 is a diagram showing the threaded neck of the container of FIG. 4 according to an exemplary embodiment.

Referring to FIG. 5, a detailed view of threading 36 is shown according to an exemplary embodiment. As shown, threading 36 includes a plurality of threads 40 having an upper surface 48 and a lower surface 49. In general container 30 includes one thread 40 for each lug 18 of closure 10. Thus, in the embodiment shown, container 30 includes five threads 40. Threads 40 are shaped and positioned to allow closure 10 to be threaded on and off of neck 32 and also facilitate the lower pressure sealing provided by closure 10. Threads 40 have a thread pitch angle or beta helix angle shown by angle A. In various embodiments, angle A is between 5 degrees and 7 degrees, specifically is about 6 degrees and more specifically is 6 degrees, 6 minutes.

Threads 40 have a front portion 42 that overlaps the rear portion 44 of the adjacent thread 40 at overlap 46. Threads 40 are sized and arranged such that overlap portion 46 facilitates threading of closure 10 on to container 30.

Figure 6:
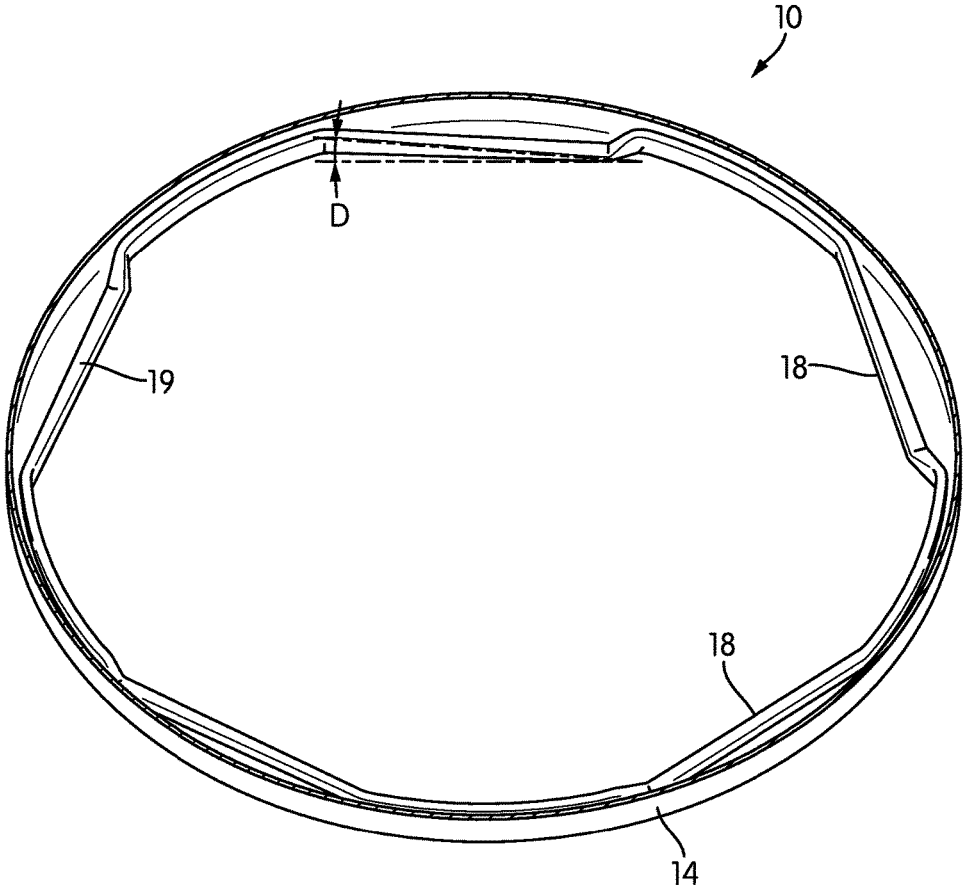
FIG. 6 is a sectional view taken along line 6-6 showing a top perspective view of the engagement surface of the lugs of the closure of FIG. 1 according to an exemplary embodiment.

FIG. 6 is a sectional view of the closure 10 taken along line 6-6 of FIG. 1 and shows a top perspective view of the upper surface of the lugs 18. As shown in FIG. 6, each lug 18 includes a thread engagement surface 19 that extends along the upper surface of the lug 18. The thread engagement surface 19 of each lug 18 is formed having an angle D, as measured between the thread engagement surface 19 and a plane along which the lower edge 16 of the closure 10 lies. In general the angle D of the thread engagement surface 19 of the lugs 18 matches the angle A of the threads 40. When the closure 10 is attached to the container 30, the thread engagement surface 19 of the lugs interfaces with the lower surface 49 of the threads 40 to seal the container 30.

Figure 7:
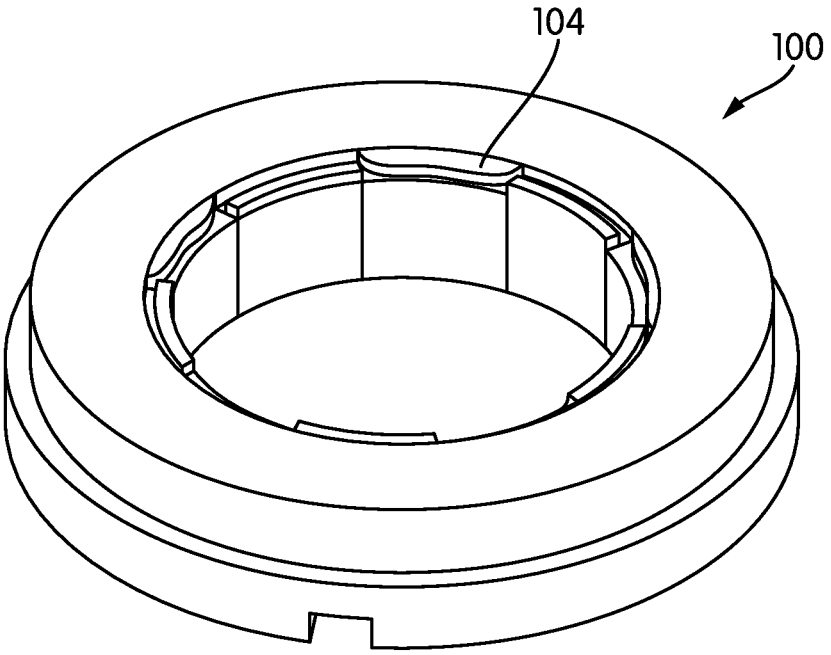
FIG. 7 is a perspective view of a lug bushing according to an exemplary embodiment.
Figure 8:
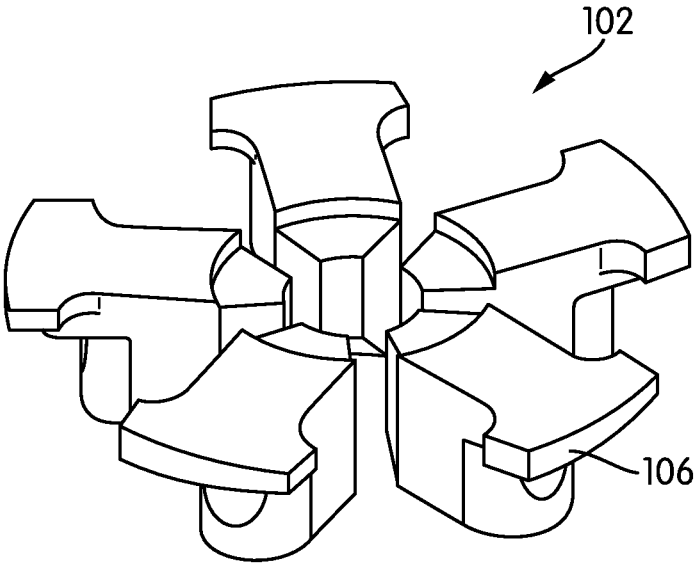
FIG. 8 is a perspective view of a lug tool according to an exemplary embodiment.

Referring to FIGS. 7-10, tooling configured to form lugs 18 is shown according to an exemplary embodiment. FIG. 7 shows lug bushing 100, and FIG. 8 shows lug tool 102. In general, lug bushing 100 includes an inner engagement surface 104 for each lug 18 to be formed, and lug tool 102 includes an outer engagement surface 106 for each lug 18 to be formed. To form lugs 18, a portion of skirt 14 is positioned between surfaces 104 and 106, and surfaces 104 and 106 engage the material of skirt 14 to form lugs 18.

Figure 9:
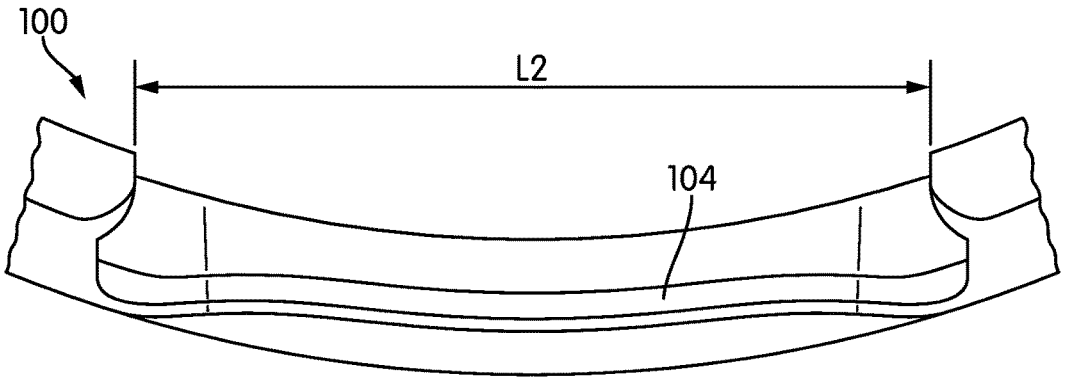
FIG. 9 is a detailed view of a portion of the lug bushing of FIG. 7 according to an exemplary embodiment.
Figure 10:
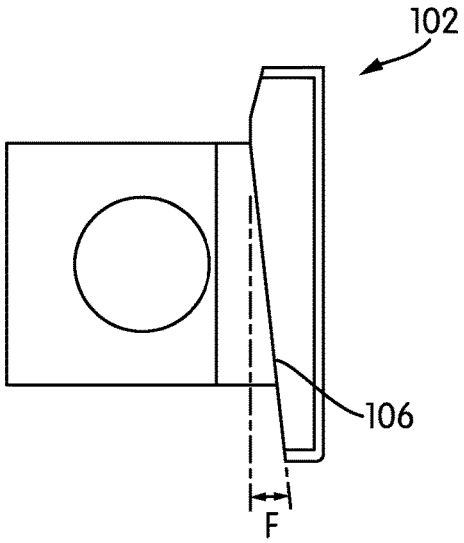
FIG. 10 is a detailed view of a portion of the lug tool of FIG. 8 according to an exemplary embodiment.

As shown in FIG. 9 and FIG. 10, surfaces 104 and 106 are shaped to form the shape of lug 18 discussed above. As shown surface 104 of lug bushing 100 has a length L2, and in general L2 matches L1 of lug 18. In various embodiments, L2 is between 0.5 inches and 1.5 inches, and in a specific embodiment, L2 is about 0.75 inches. As shown in FIG. 10, surface 106 forms an angle F, and in various embodiments, angle F matches angle A of threads 40 and D of the engagement surface 19 of the lugs 18.

Also, as shown in FIG. 8, the angled surface 106 is disposed about the lug tool 102 as a curved, outer surface of the lug tool 102. This curved outer surface of the lug tool 102 defined by the angled surface 106 has a radius that matches the radius of the thread profile. When lugs 18 are formed using the lug tool 102, the resulting thread engagement surface 19 of the lug 18 is formed with a radius that matches the radius of the thread profile. Because the thread engagement surface 19 extends radially along the lug 18 rather than being formed linearly, the contact area between the lugs 18 and the threads 40 is increased, resulting in a decreased amount of pressure being imparted on the neck 32 of the container 30 by the closure 10.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A container assembly comprising:

a container including a polymeric body and a polymeric neck, the polymeric neck including a plurality of threads;

a closure comprising:

a top panel;

a skirt extending downwards from an outer periphery of the top panel;

a lower edge defining a lower portion of the skirt;

five lugs spaced apart and extending radially inwards towards a center of the closure along a periphery of the lower edge, the lugs being formed from a metallic material;

each of the lugs having a length of at least 0.5 inches as measured in a circumferential direction, and having a first end and a second end, the width of the lug as measured in a radial direction being greater at the first end than at the second end;

a gasket extending about a portion of a lower surface of the top panel corresponding to a location of the closure configured to overlie an upper rim of the container neck when the closure is secured to the container neck;

wherein the gasket is configured to provide an air-tight seal between the closure and the container when the closure is secured to the container neck;

wherein the container is configured to be filled with food or beverage contents and withstand temperatures of up to 275° F. when the container filled with contents undergoes a hot-fill, steam retort, pasteurization or sterilization process;

wherein the lugs are located at positions about the lower edge such that a midpoint of each lug is spaced approximately 72 degrees±1 degree from a midpoint of an adjacent lug as measured from a center of the closure; and wherein the plurality of lugs occupy at least 25% of the perimeter of the lower edge.

2. The container assembly of claim 1, wherein the top wall, skirt and lugs are formed from a single contiguous piece of metal.

3. The container assembly of claim 1, wherein each lug accounts for between 5 percent and 15 percent of the circumference of the lower edge.

4. The container assembly of claim 1, wherein the length of each lug is at least 0.7 inches.

5. The container assembly of claim 1, wherein the lugs are formed about the lower edge of the skirt such that none of the lugs lie diametrically opposite each other.

6. The container assembly of claim 1, wherein the portion of the lugs configured to engage the threads includes an angled portion, the angled portion of the lugs having an angle that matches the angle of the threads.

7. The container assembly of claim 6, wherein the threads have a thread angle between 5 degrees and 7 degrees.

8. The container assembly of claim 1, wherein an angle between a first end of a first lug and a second end of an adjacent lug is between approximately 30 degrees and approximately 50 degrees as measured from a center of the closure.

9. A container assembly comprising:

a container including a polymeric body and a polymeric neck, the polymeric neck including a plurality of threads;

a closure comprising:

a top panel;

a skirt extending downwards from an outer periphery of the top panel;

a lower edge defining a lower portion of the skirt; and five metallic lugs spaced apart and extending radially inwards towards a center of the closure along a periphery of the lower edge;

each of the lugs having a length of at least 0.5 inches as measured in a circumferential direction, and having a first end and a second end, the width of the lug as measured in a radial direction being greater at the first end than at the second end;

each of the lugs having an upper surface, the upper surface of each lug defining a thread-engaging surface configured to contact a lower surface of a thread when the closure is secured to the container;

wherein the thread-engaging surface of each lug is configured to simultaneously contact both an outer surface of the container neck and the lower surface of a thread when the closure is secured to the container;

wherein the lugs are located at positions about the lower edge such that a midpoint of each lug is spaced approximately 72 degrees±1 degree from a midpoint of an adjacent lug as measured from a center of the closure; and wherein the plurality of lugs occupy at least 25% of the perimeter of the lower edge.

10. The container assembly of claim 9, wherein each lug accounts for between 5 percent and 15 percent of the circumference of the lower edge.

11. The container assembly of claim 10, wherein the length of each lug is between 0.7 and 0.8 inches.

12. The container assembly of claim 9, wherein an angle between a first end of a first lug and a second end of an adjacent lug is between approximately 30 degrees and approximately 50 degrees as measured from a center of the closure.

13. The container assembly of claim 9, each of the threads being arranged about the neck at an angle, wherein the thread angle and an angle of the lug engagement surfaces is 6 degrees and 6 minutes.

14. The container assembly of claim 9, wherein the container is configured to be filled with food or beverage contents and withstand temperatures of up to 275° F. when the container filled with contents undergoes a hot-fill, steam retort, pasteurization or sterilization process.

15. A closure comprising:

a top panel;

a skirt extending downwards from an outer periphery of the top panel, the skirt having a first end attached to the top panel and a second end defined by a lower edge;

five metallic lugs spaced apart and extending radially inwards towards a center of the closure along a periphery of the lower edge;

wherein the lower edge of the skirt is deformed to form each of the lugs, each lug being separated from an adjacent lug by an undeformed portion of the skirt lower edge;

each of the lugs having a first end and a second end, the width of each lug as measured in a radial direction being greater at the first end than at the second such that the first end of each lug extends further towards a center of the closure than the second end;

each of the lugs having a length of at least 0.5 inches as measured in a circumferential direction, and having a first end and a second end, the width of the lug as measured in a radial direction being greater at the first end than at the second end;

wherein an angle between a first end of a first lug and a second end of an adjacent lug is between approximately 30 degrees and approximately 50 degrees as measured from the center of the closure;

wherein the lugs are located at positions about the lower edge such that a midpoint of each lug is spaced approximately 72 degrees±1 degree from a midpoint of an adjacent lug as measured from a center of the closure; and wherein the plurality of lugs occupy at least 25% of the perimeter of the lower edge.

16. The closure of claim 15, wherein the length of each lug is at least 0.7 inches.

17. The closure of claim 15, wherein the lugs are formed about the lower edge of the skirt such that none of the lugs lie diametrically opposite each other.

18. The closure assembly of claim 15, wherein the number of lugs is five.

* * * * *